US009088095B2

(12) United States Patent
Yokoyama et al.

(10) Patent No.: US 9,088,095 B2
(45) Date of Patent: Jul. 21, 2015

(54) CONNECTOR AND MATING CONNECTOR

(71) Applicants: JAPAN AVIATION ELECTRONICS INDUSTRY, LIMITED, Shibuya-ku, Tokyo (JP); JAE TAIWAN, LTD., Taichung, R.O.C. (TW)

(72) Inventors: Yohei Yokoyama, Tokyo (JP); Masafumi Kodera, Taichung (TW)

(73) Assignees: JAPAN AVIATION ELECTRONICS INDUSTRY, LIMITED, Tokyo (JP); JAE TAIWAN, LTD., Taichung (TW)

( * ) Notice: Subject to any disclaimer, the term of this patent is extended or adjusted under 35 U.S.C. 154(b) by 128 days.

(21) Appl. No.: 13/919,979

(22) Filed: Jun. 17, 2013

(65) Prior Publication Data

US 2013/0344734 A1 Dec. 26, 2013

(30) Foreign Application Priority Data

Jun. 20, 2012 (JP) ..... 2012-139084

(51) Int. Cl.

| | |
|---|---|
| ***H01R 13/60*** | (2006.01) |
| ***H01R 12/70*** | (2011.01) |
| *H01R 13/6594* | (2011.01) |
| *H01R 43/16* | (2006.01) |

(52) U.S. Cl.

CPC ..... *H01R 13/60* (2013.01); *H01R 12/7011* (2013.01); *H01R 13/6594* (2013.01); *H01R 43/16* (2013.01)

(58) Field of Classification Search

CPC .. H01R 23/688; H01R 13/514; H01R 13/518; H01R 13/65807; H01R 23/7073; H01R 33/7628; H01R 2103/00; H04R 5/00; H04R 2430/01

USPC ..... 439/569–571, 159, 607.07

See application file for complete search history.

(56) References Cited

U.S. PATENT DOCUMENTS

| | | | | |
|---|---|---|---|---|
| 4,639,066 | A * | 1/1987 | Shimamiya et al. | 439/569 |
| 5,194,019 | A * | 3/1993 | Rose | 439/569 |
| 6,007,381 | A | 12/1999 | Ando et al. | |
| 6,224,420 | B1 * | 5/2001 | Nishio et al. | 439/566 |
| 6,231,382 | B1 * | 5/2001 | Yu | 439/541.5 |
| 6,305,984 | B1 | 10/2001 | Katoh et al. | |
| 6,319,063 | B1 * | 11/2001 | Huang | 439/607.36 |
| 6,354,870 | B1 * | 3/2002 | Timmerman | 439/569 |
| 6,354,871 | B1 * | 3/2002 | Hatakeyama | 439/573 |
| 6,398,587 | B1 * | 6/2002 | Chen et al. | 439/607.35 |
| 6,626,689 | B1 * | 9/2003 | Yu | 439/159 |

(Continued)

FOREIGN PATENT DOCUMENTS

| | | | | |
|---|---|---|---|---|
| FR | 2785725 | A1 * | 5/2000 | H01R 12/20 |
| JP | 11-67365 | A | 3/1999 | |

(Continued)

*Primary Examiner* — Abdullah Riyami
*Assistant Examiner* — Vladimir Imas
(74) *Attorney, Agent, or Firm* — Holtz, Holtz, Goodman & Chick PC

(57) ABSTRACT

A connector is fixable to an object such as a circuit board. The connector comprises a shell. The shell has a body portion and a fixing portion for fixing the body portion to the circuit board. The body portion is provided with an engagement piece. The fixing portion has a flange and an opening. The flange is configured to be screwed to and pressed against the circuit board. The opening is engaged with the engagement piece so as to press the engagement piece toward the circuit board when the flange is pressed against the circuit board.

7 Claims, 4 Drawing Sheets

(56) References Cited

U.S. PATENT DOCUMENTS

| | | | | |
|---|---|---|---|---|
| 6,666,694 | B1 * | 12/2003 | Daly et al. | 439/79 |
| 6,722,921 | B1 * | 4/2004 | Yu | 439/573 |
| 6,736,656 | B1 * | 5/2004 | Yu | 439/159 |
| 6,755,671 | B1 * | 6/2004 | Fan et al. | 439/108 |
| 6,824,425 | B2 * | 11/2004 | Fan | 439/570 |
| 6,884,116 | B2 | 4/2005 | Suzuki et al. | |
| 7,044,748 | B2 * | 5/2006 | Korsunsky et al. | 439/74 |
| 7,074,085 | B2 * | 7/2006 | Chen | 439/607.36 |
| 7,331,818 | B2 * | 2/2008 | Wu et al. | 439/573 |
| 7,458,824 | B2 * | 12/2008 | Ogawa et al. | 439/76.2 |
| 7,604,509 | B2 * | 10/2009 | Ting | 439/630 |
| 7,618,268 | B2 * | 11/2009 | Ko et al. | 439/101 |
| 7,651,360 | B2 * | 1/2010 | Cheng | 439/345 |
| 8,485,849 | B2 * | 7/2013 | Ahn et al. | 439/607.01 |
| 8,696,384 | B2 * | 4/2014 | Yokoyama et al. | 439/607.4 |
| 8,851,928 | B2 * | 10/2014 | He | 439/607.37 |
| 2004/0121632 | A1 * | 6/2004 | Takata | 439/83 |
| 2004/0219830 | A1 * | 11/2004 | Fan | 439/570 |
| 2005/0221667 | A1 * | 10/2005 | Higuchi | 439/566 |
| 2006/0189182 | A1 * | 8/2006 | Higeta et al. | 439/79 |

FOREIGN PATENT DOCUMENTS

| | | | |
|---|---|---|---|
| JP | 2000-357550 | A | 12/2000 |
| JP | 2004-014350 | A | 1/2004 |

* cited by examiner

CONNECTOR AND MATING CONNECTOR

CROSS REFERENCE TO RELATED APPLICATIONS

Applicants claim priority under 35 U.S.C. §119 of Japanese Patent Application No. JP2012-139084 filed Jun. 20, 2012.

BACKGROUND OF THE INVENTION

This invention relates to a connector configured to be fixed to an object such as a printed circuit board, a Flexible Printed Circuit (FPC) and a Flexible Flat Cable (FFC).

For example, a connector configured to be fixed to a circuit board is disclosed in JP-A H11(1999)-67365 (Patent Document 1), contents of which are incorporated herein by reference.

As shown in FIG. 7, the connector 900 of Patent Document 1 comprises a shell 910 which is formed by bending a metal plate. The shell 910 is formed with opposite sidewalls 920 which constitute a mating portion. Each of the sidewalls 920 is formed with a first peg 924 extending therefrom. The shell 910 is further formed with two cover walls 930 covering the respective sidewalls 920. Each of the cover walls 930 is formed with a second peg 934 extending therefrom. The connector 900 has the second pegs 934 in addition to the first pegs 924 so that the connector 900 is more securely fixed to the circuit board.

The cover wall 930 is formed with a window 932 while the sidewall 920 is provided with an engagement piece 922. The engagement piece 922 is engaged with the window 932. According to Patent Document 1, this engagement prevents the cover wall 930 from moving along the sidewall 920.

It is impossible to form the engagement piece 922 having absolutely the same size as the window 932. Accordingly, the actually formed engagement piece 922 should have smaller size than the window 932. Moreover, as can be seen from the forming method of the shell 910 described in paragraph [0017] of Patent Document 1, although a front edge of the engagement piece 922 is engaged with a front end of the window 932, a gap is formed between the engagement piece 922 and an edge of the window 932 in the vertical direction. The cover wall 930 is therefore easily movable upward or downward along the sidewall 920. Accordingly, the shell 910 might be shaken or deformed when the connector 900 receives such a force that detaches the connector 900 from the object such as a circuit board.

SUMMARY OF THE INVENTION

It is therefore an object of the present invention to provide a connector having a structure which is preventable a shell of the connector from being deformed even when the connector receives such a force that detaches the connector from an object such as a circuit board.

One aspect of the present invention provides a connector fixable to an object and receivable a part of a mating connector inserted thereinto from a front end thereof in a front-rear direction. The connector comprises a contact, a holding member and a shell. The holding member holds the contact. The shell is attached to the holding member. The shell has a body portion and a fixing portion. The body portion covers, at least in part, the holding member. The fixing portion is configured to fix the body portion to the object. The body portion is provided with a first engaged portion. The fixing portion has a pressed portion and a second engaged portion. The pressed portion is configured to be secured to the object by screw to be pressed against the object. The second engaged portion is engaged with the first engaged portion so as to press the first engaged portion toward the object when the pressed portion is pressed against the object.

An appreciation of the objectives of the present invention and a more complete understanding of its structure may be had by studying the following description of the preferred embodiment and by referring to the accompanying drawings.

Figure 1:
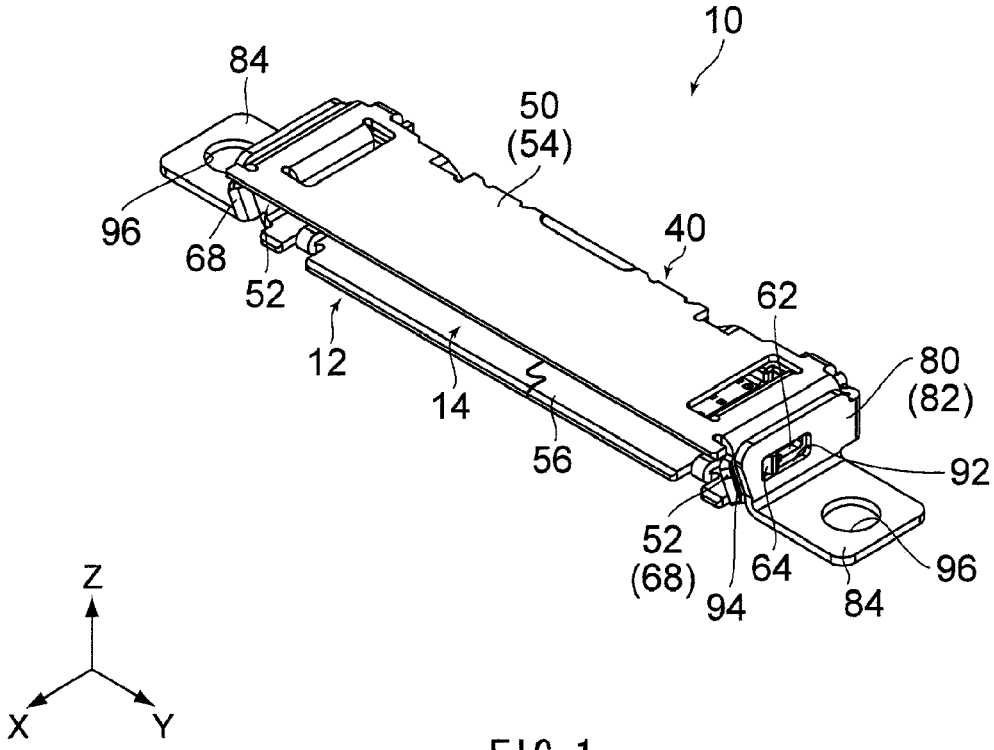
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
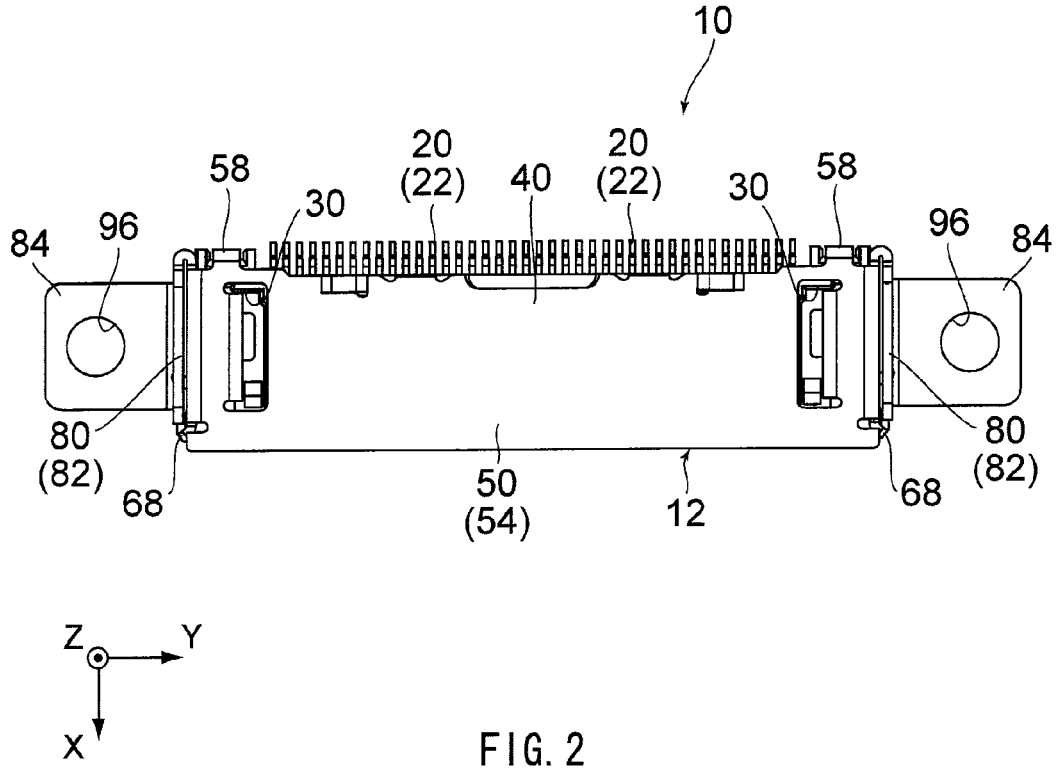
FIG. 2 is a top view showing the connector of FIG. 1.
Figure 3:
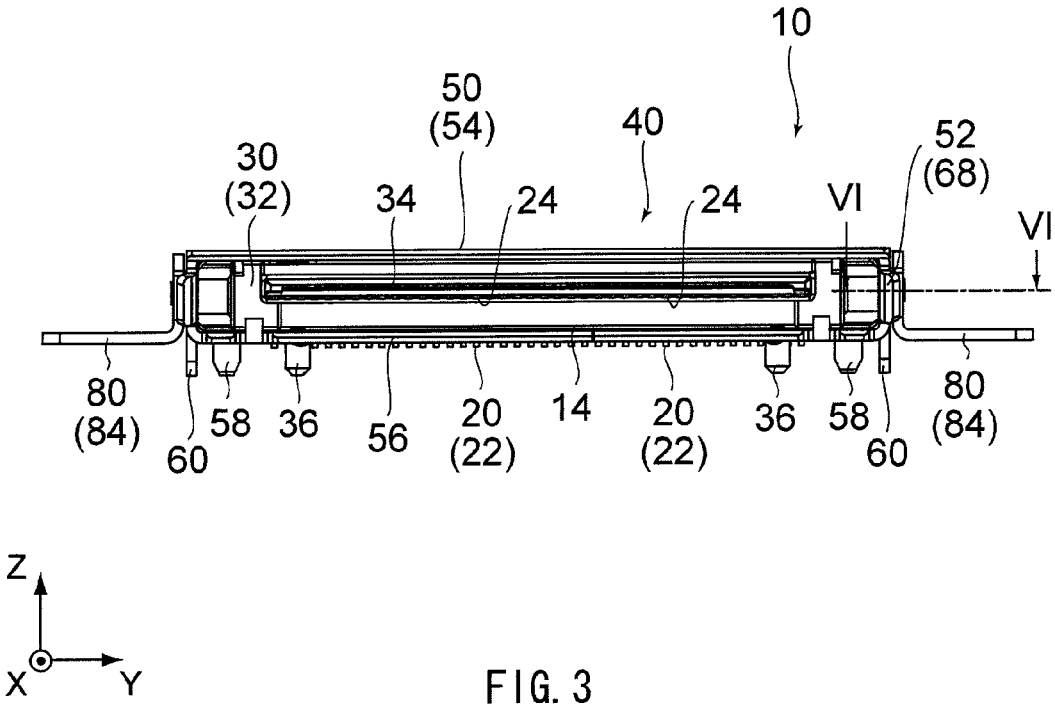
FIG. 3 is a front view showing the connector of FIG. 1.
Figure 4:
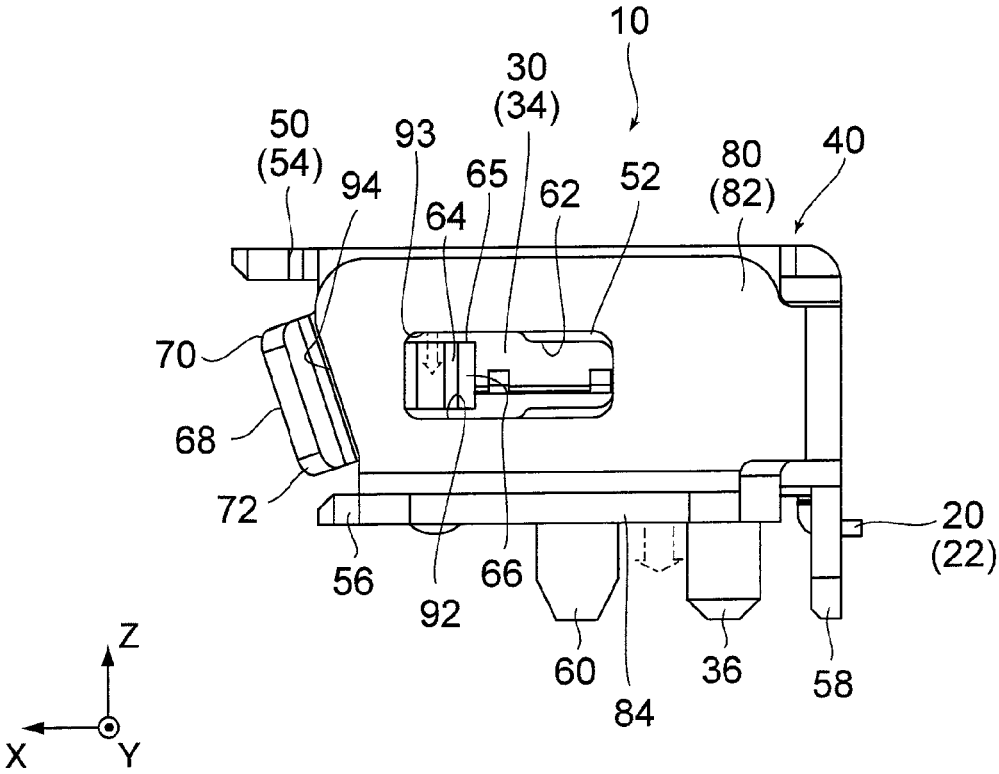
FIG. 4 is a side view showing the connector of FIG. 1.

Referring to FIG. 1, a connector 10 according to an embodiment of the present invention is fixable to an object such as a circuit board (not shown). The connector 10 is receivable a part of a mating connector (not shown). In detail, the connector 10 has a front end 12 in a front-rear direction (X-direction) and a receive portion 14. The receive portion 14 is receivable a part of the mating connector inserted thereinto from the front end 12 in the X-direction. As can be seen from the above description, according to the present embodiment, an insertion-removal direction of the mating connector is the front-rear direction. As shown in FIGS. 2 to 4, the connector 10 comprises a plurality of contacts 20 each made of a conductive material, a holding member 30 made of an insulating material and a shell 40 made of a metal. The holding member 30 holds the contacts 20. The shell 40 is attached to the holding member 30.

As can be seen from FIGS. 2 and 3, each of the contacts 20 has a surface mount technology (SMT) terminal 22 and a contact portion 24. Each of the SMT terminals 22 is soldered to be fixed to a conductive pattern (not shown) on the circuit board (not shown) when the connector 10 is fixed to the circuit board. Each of the contact portions 24 is brought into contact with a contact of the mating connector (not shown) when the connector 10 receives the mating connector. The contact 20 may have a through hole mount (THM) terminal, which is soldered to be fixed to the circuit board after inserted in the circuit board, instead of the SMT terminal 22.

As shown in FIG. 3, the holding member 30 has a rear block 32, a mating portion 34 and two positioning bosses 36. The rear block 32 is located at a rear side (i.e. negative X-side) of the holding member 30. The rear block 32 extends long in a pitch direction (Y-direction). As can be seen from FIGS. 2 and 4, the mating portion 34 is located within the receive portion 14. The mating portion 34 has a plate-like shape protruding forward (i.e. along the positive X-direction) from the rear block 32. The positioning bosses 36 are configured to position the connector 10 on the circuit board (not shown). In detail, the positioning bosses 36 project downward (i.e. along the negative Z-direction) from the rear block 32. When the connector 10 is mounted on the circuit board, the positioning bosses 36 are inserted into respective positioning holes (not shown) formed in the circuit board so that the connector 10 is positioned to a predetermined mount position on the circuit board. As can be seen from FIGS. 2 and 3, the contacts 20 are held by the holding member 30 so as to be arranged in the pitch direction (Y-direction). The contact portion 24 of the contact 20 protrudes downward (i.e. along the negative Z-direction) from the mating portion 34.

The shell 40 according to the present embodiment is formed by bending an intermediate member which is stamped out from a single metal sheet. As shown in FIGS. 1 to 4, the shell 40 has a body portion 50 and two fixing portions 80. The body portion 50 covers, at least in part, the holding member 30. The fixing portions 80 are configured to fix opposite ends of the body portion 50 to the circuit board (not shown), respectively.

As best shown in FIG. 3, the body portion 50 has a square tube-like shape extending short in the front-rear direction (X-direction). As seen from the front (i.e. from the positive X-side), the body portion 50 has a rectangular shape which is long in the pitch direction (Y-direction). Thus configured body portion 50 has two sidewalls 52, a top plate 54 and a bottom plate 56. The sidewalls 52 are located at opposite ends of the body portion 50 in the pitch direction (Y-direction), respectively. Each of the sidewalls 52 has an upper end (i.e. positive Z-side end) and a lower end (i.e. negative Z-side end). The top plate 54 couples the upper ends of the sidewalls 52 in the pitch direction (Y-direction). The top plate 54 extends in parallel to the mating portion 34. In detail, the top plate 54 is located in a plane parallel to a horizontal plane (XY-plane) defined by the front-rear direction (X-direction) and the pitch direction (Y-direction). The sidewall 52 is located in a vertical plane (XZ-plane) perpendicular to the horizontal plane (XY-plane) in which the top plate 54 is located. The bottom plate 56 is comprised of two portions which are caulked to be connected to each other. The aforementioned two portions extend inward in the pitch direction (Y-direction) from the respective lower ends of the sidewalls 52 to be connected to each other in the vicinity of the middle of the bottom plate 56.

As can be seen from FIGS. 2 to 4, the body portion 50 is provided with two types of posts, namely, a post 58 and a post 60. The body portion 50 according to the present embodiment has the two posts 58 and the two posts 60. The posts 58 extend downward (i.e. along the negative Z-direction) from a rear end (i.e. negative X-side end) of the top plate 54. The posts 60 extend downward from the lower ends (i.e. negative Z-side ends) of the sidewalls 52. As can be seen from FIGS. 3 and 4, the post 58 and the post 60 are provided in respective two planes which are perpendicular to each other. More specifically, the posts 58 are located in a vertical plane (YZ-plane) perpendicular to the front-rear direction (X-direction) while the posts 60 are located in a vertical plane (XZ-plane) perpendicular to the vertical plane (YZ-plane) in which the posts 58 are located. Thus configured posts 58 and the posts 60 are inserted into and fixed to the circuit board (not shown) when the connector 10 is mounted on and fixed to the circuit board. Accordingly, a movement in the horizontal plane (XY-plane) of the body portion 50 of the connector 10 mounted on the circuit board is regulated.

Figure 5:
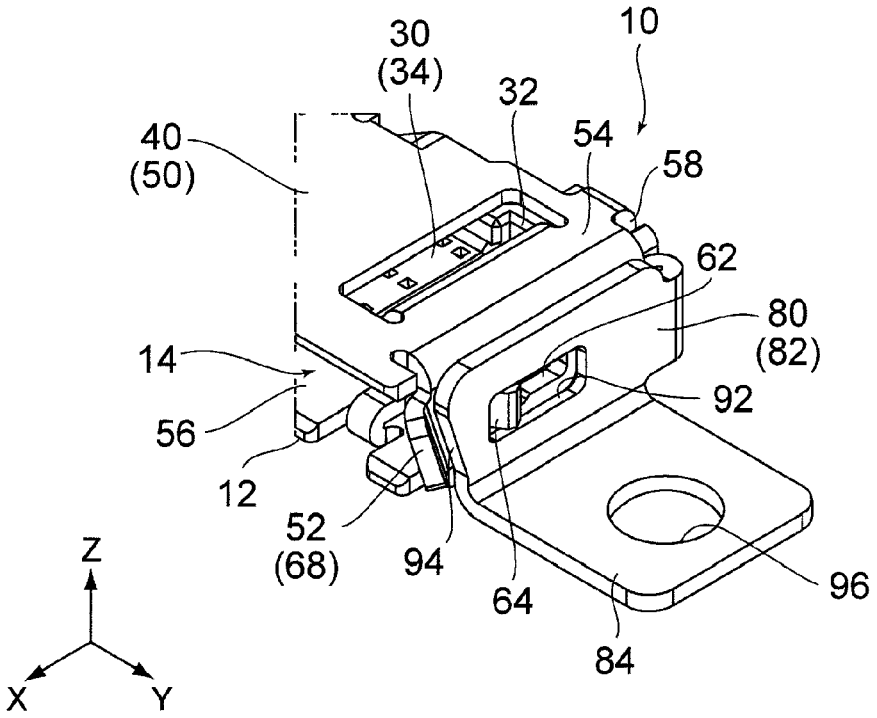
FIG. 5 is a partially enlarged, perspective view showing about a fixing portion of the connector of FIG. 1.
Figure 6:
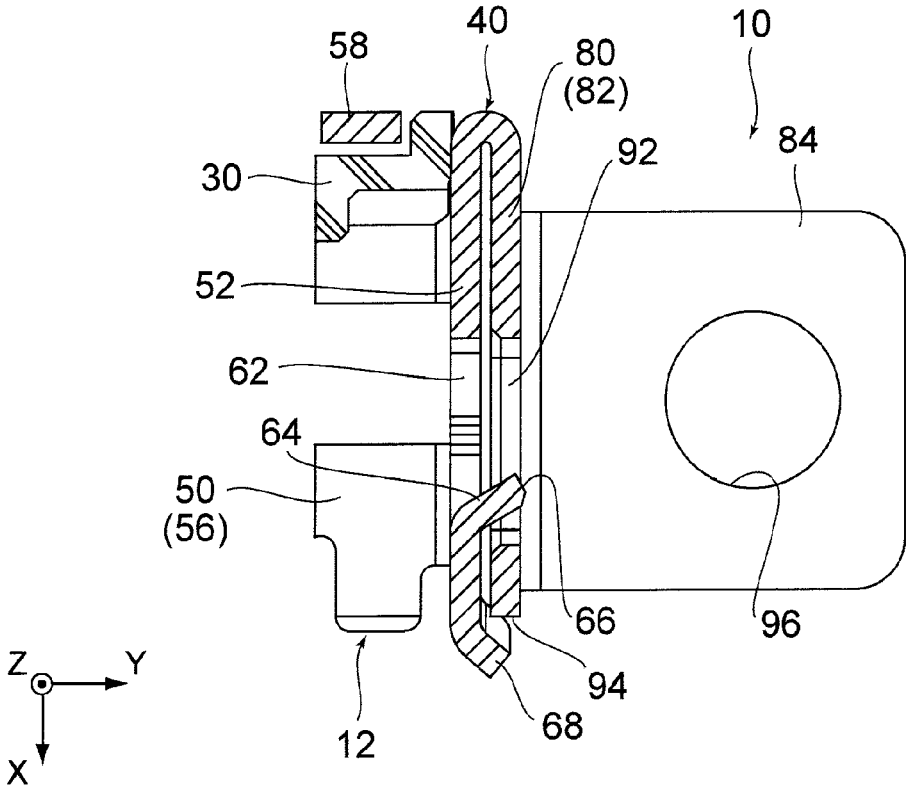
FIG. 6 is a cross-sectional view showing about the fixing portion of the connector of FIG. 3, taken along line VI-VI.
Figure 7:
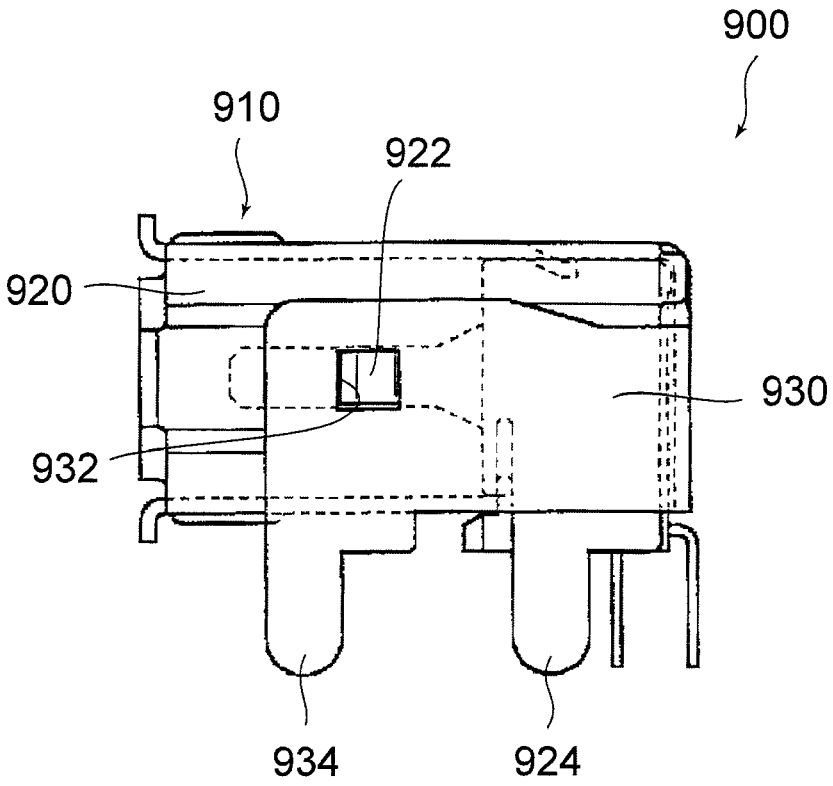
FIG. 7 is a side view showing an existing connector.

As can be seen from FIGS. 4 to 6, each of the sidewalls 52 is provided with a lock hole (hole) 62, an engagement piece (first engaged portion) 64 and a guide portion 68. Accordingly, the body portion 50 has the two lock holes 62, the two first engaged portions 64 and the two guide portions 68.

The lock hole 62 pierces the sidewall 52 in the pitch direction (Y-direction) while extending long in the front-rear direction (X-direction). The mating connector (not shown) according to the present embodiment comprises two lock pieces (not shown) corresponding to the lock holes 62, respectively. The lock pieces are formed at opposite ends of the mating connector in the pitch direction (Y-direction), respectively. When the connector 10 is under a mated state where the connector 10 receives (i.e. is mated with) the mating connector, the lock holes 62 according to the present embodiment receive the respective lock pieces of the mating connector to lock the mated state.

The engagement pieces 64 according to the present embodiment are formed from the sidewalls 52, respectively. More specifically, a part of the sidewall 52 is cut and bent to form the engagement piece 64. The engagement piece 64 protrudes outward in the pitch direction (Y-direction) from a front end of the lock hole 62 while extending obliquely rearward. The engagement piece 64 has two edges each perpendicular to the vertical direction (Z-direction), namely, an upper edge and a lower edge. The engagement piece 64 also has a front end and a rear end 66. The front end of the engagement piece 64 is located at the same position as the front end of the lock hole 62 in the front-rear direction (X-direction). The rear end 66 is located rearward of the front end of the lock hole 62 and located outward of the front end of the engagement piece 64 in the pitch direction (Y-direction).

The guide portions 68 according to the present embodiment guide the mating connector (not shown) upon an insertion of the mating connector. In detail, the guide portions 68 are provided at respective front ends (i.e. positive X-side ends) of the opposite sidewalls 52 so as to open outward in the pitch direction (Y-direction). As shown in FIG. 4, each of the guide portions 68 has an upper end 70 and a lower end 72. The guide portion 68 extends in a direction oblique to the vertical direction (Z-direction) so that the upper end 70 of the guide portion 68 is located forward of the lower end 72 of the guide portion 68.

As shown in FIGS. 2 and 5, each of the fixing portions 80 has a facing portion 82 and a flange (pressed portion) 84. The facing portions 82 face the sidewalls 52 in the pitch direction (Y-direction), respectively. Each of the facing portions 82 is formed with a lower end (i.e. negative Z-side end) in the vertical direction (Z-direction). The flanges 84 extend outward in the pitch direction (Y-direction) from the respective lower ends of the facing portions 82.

As shown in FIG. 6, each of the sidewalls 52 of the body portion 50 has a front end and a rear end in the front-rear direction (X-direction). The facing portion 82 of each of the fixing portions 80 has a front edge 94 and a rear end in the front-rear direction (X-direction). The rear end of the sidewall 52 and the rear end of the facing portion 82 are coupled with each other. In detail, the facing portion 82 is folded back at the rear end (i.e. negative X-side end) of the sidewall 52 so as to extend forward (i.e. along the positive X-direction).

As shown in FIGS. 4 to 6, the facing portion 82 is formed with an opening (second engaged portion) 92. In other words, each of the fixing portions 80 has the opening 92. The opening 92 pierces the facing portion 82 in the pitch direction (Y-direction). The opening 92 partially overlaps the lock hole 62 in a vertical plane (XZ-plane) which is in parallel to the sidewall 52. Moreover, the lock hole 62 at least partially communicates with the opening 92 in the pitch direction (Y-direction). Accordingly, as shown in FIG. 4, when the connector 10 is seen along the pitch direction (Y-direction), the mating portion 34 of the holding member 30 located within the receive portion 14 is visible through the opening 92 and the lock hole 62.

As best shown in FIG. 6, the engagement piece 64 extends to inside of the opening 92. Especially, the engagement piece 64 according to the present embodiment is securely inserted in the opening 92. In detail, the engagement piece 64 extends through the inside of the opening 92 so that the rear end 66 of the engagement piece 64 partially projects outward from the facing portion 82 in the pitch direction (Y-direction). However, the engagement piece 64 may extend into the opening 92 without projecting from the facing portion 82.

As best shown in FIG. 4, the front edge 94 of the facing portion 82 is oblique to the vertical direction (Z-direction). In detail, the front edge 94 extends obliquely upward and forward (i.e. along a direction oblique to both the positive X-direction and the positive Z-direction) from the vicinity of the lower end of the facing portion 82. In other words, the front edge 94 has a shape protruding forward and upward. The guide portion 68 is located in front of the front edge 94.

As shown in FIGS. 1, 2, 5 and 6, each of the flanges 84 is provided with a screw hole 96. The flanges 84 are secured to the circuit board (not shown) by screw to be pressed against the circuit board when the connector 10 is mounted on and fixed to the circuit board. As can be seen from FIG. 4, when the flange 84 is pressed against the circuit board, the facing portion 82 also moves toward the circuit board. In other words, the entire fixing portion 80 moves toward the circuit board. Accordingly, the upper edge 93 of the opening 92 is engaged with the upper end 65 of the engagement piece 64. In the meantime, the facing portion 82 presses the engagement piece 64 toward the circuit board so that the engagement piece 64 moves downward (see two arrows illustrated in FIG. 4 by chain dotted lines). The pressed and moved engagement piece 64 keeps the body portion 50 including the sidewalls 52 in a state where the body portion 50 is pushed down toward the circuit board. Accordingly, it is possible to suppress a movement of the body portion 50 in the vertical direction (Z-direction). Especially, it is possible to suppress an upward movement along the positive Z-direction of the body portion 50. As can be seen from the above description, the opening 92 is engaged with the engagement piece 64 so as to press the engagement piece 64 toward the circuit board when the flange 84 is pressed against the circuit board. As shown in FIG. 4, according to the present embodiment, the upper edge 93 of the opening 92 is apart from the upper end 65 of the engagement piece 64 by a gap. However, the upper end 65 of the engagement piece 64 may be close to the upper edge 93 of the opening 92 before the flange 84 is screwed to the circuit board.

The connector 10 according to the present embodiment is mateable with various types of the mating connectors (not shown). For example, the mating connector may be a cable connector connectable to a cable (not shown). If the cable connected to the mating connector is swayed, the connector 10 fixed to the circuit board (not shown) and mated with the mating connector might receive such a force (i.e. an upward force) that detaches the connector 10 from the circuit board. According to the present embodiment, even if the aforementioned upward force is applied to the connector 10, an engagement of the engagement piece 64 with the opening 92 keeps pushing down the body portion 50 toward the circuit board. Accordingly, it is possible to prevent the shell 40 from being deformed.

According to the present embodiment, both the guide portion 68 of the sidewall 52 and the front edge 94 of the facing portion 82 protrude forward while extending upward. Moreover, the facing portion 82 of the fixing portion 80 is securely fixed to the circuit board (not shown) by the flange 84. Accordingly, even if the body portion 50 is nearly pushed up along the positive Z-direction by the aforementioned upward force, the guide portion 68 is brought into abutment with and stopped by a lower end of the front edge 94. Accordingly, it is possible to prevent the shell 40 from being deformed more securely.

The aforementioned embodiment is able to be modified variously.

For example, according to the aforementioned embodiment, the first engaged portion is the engagement piece 64 while the second engaged portion is the opening 92. However, the first engaged portion and the second engaged portion may be formed differently by using members or parts which are engageable with each other. For example, the first engaged portion may be an opening while the second engaged portion may be an engagement piece.

Moreover, according to the aforementioned embodiment, the engagement piece 64 extends obliquely rearward from the front end thereof. However, the engagement piece 64 may extend differently. For example, the engagement piece 64 extends obliquely forward from the rear end thereof.

Moreover, the engaged portions according to the aforementioned embodiment, namely, the first engaged portion (engagement piece) 64 and the second engaged portion (opening) 92, are provided at a side part of the shell 40. However, one or both of the engaged portions may be provided on the other part of the shell 40. For example, the engaged portion may provided at a front part of the shell 40, which is the mating side with the mating connector (not shown). More specifically, the guide portion 68 may be partially bent toward the receive portion 14 so that the guide portion 68 may be formed with the engaged portion.

Moreover, according to the aforementioned embodiment, both the guide portion 68 of the sidewall 52 and the front edge 94 of the facing portion 82 are oblique to the vertical direction (Z-direction). However, for example, if the front edge 94 is not required to stop the movement of the guide portion 68, each of the guide portion 68 and the front edge 94 may not be oblique to the vertical direction (Z-direction).

The present application is based on a Japanese patent application of JP2012-139084 filed before the Japan Patent Office on Jun. 20, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector fixable to an object and configured to receive a part of a mating connector inserted thereinto from a front end thereof in a front-rear direction, the connector comprising:

a contact;

a holding member holding the contact; and a shell attached to the holding member, the shell comprising a body portion and a fixing portion, the body portion covering, at least in part, the holding member, the fixing portion being configured to fix the body portion to the object, the body portion being provided with a first engaged portion, the fixing portion comprising a pressed portion and a second engaged portion, the pressed portion being configured to be secured to the object by a screw so as to be pressed against the object, and the second engaged portion being engaged with the first engaged portion so as to press the first engaged portion toward the object when the pressed portion is pressed against the object;

wherein:

the body portion has a sidewall located at an end thereof in a pitch direction perpendicular to the front-rear direction;

the first engaged portion is formed at the sidewall;

the fixing portion further comprises a facing portion, the facing portion facing the sidewall at which the first engaged portion is formed;

the second engaged portion is formed at the facing portion;

the sidewall has a rear end in the front-rear direction;

the facing portion has a rear end in the front-rear direction; and the rear end of the sidewall and the rear end of the facing portion are coupled with each other.

2. The connector as recited in claim 1, wherein:

the first engaged portion is an engagement piece protruding outward in the pitch direction while extending obliquely rearward; and the second engaged portion is an opening.

3. The connector as recited in claim 1, wherein:

the facing portion being is formed with a lower end in a vertical direction perpendicular to both the front-rear direction and the pitch direction; and the pressed portion extends outward in the pitch direction from the lower end of the facing portion.

4. The connector as recited in claim 3, wherein:

the sidewall further has a front end in the front-rear direction;

the facing portion further has a front edge in the front-rear direction;

the front edge of the facing portion has a shape protruding forward and upward;

the front end of the sidewall is formed with a guide portion which guides the mating connector upon insertion of the mating connector, the guide portion being located in front of the front edge of the facing portion, and the guide portion opening outward in the pitch direction; and the guide portion extends in a direction oblique to the vertical direction so that an upper end of the guide portion is located forward of a lower end of the guide portion.

5. The connector as recited in claim 3, wherein:

the second engaged portion is an opening;

the sidewall of the body portion is formed with a hole piercing the sidewall in the pitch direction;

the hole at least partially communicates with the second engaged portion in the pitch direction; and the first engaged portion extends into or through the second engaged portion from a front end of the hole.

6. The connector as recited in claim 3, wherein the body portion comprises two of the sidewalls located at opposite ends thereof in the pitch direction, respectively, and two of the fixing portions are provided such that each sidewall has a fixing portion corresponding thereto.

7. The connector as recited in claim 6, wherein:

the body portion has a top plate and a post, the top plate coupling the sidewalls in the pitch direction, the post extending downward from the top plate; and the post is inserted into and fixed to the object when the connector is fixed to the object.

* * * * *

UNITED STATES PATENT AND TRADEMARK OFFICE

CERTIFICATE OF CORRECTION

PATENT NO. : 9,088,095 B2
APPLICATION NO. : 13/919979
DATED : July 21, 2015
INVENTOR(S) : Yohei Yokoyama et al.

It is certified that error appears in the above-identified patent and that said Letters Patent is hereby corrected as shown below:

In the Specification:

Column 6, line 36, delete “may” and insert --may be--.

In the Claims:

Column 7, claim 3, line 31, after “portion” delete “being”.

Signed and Sealed this
Twenty-ninth Day of March, 2016

Michelle K. Lee

Michelle K. Lee
*Director of the United States Patent and Trademark Office*